United States Patent [19]

Green et al.

[11] 4,408,803

[45] Oct. 11, 1983

[54] HUB ASSEMBLY FOR ROLLER SKATES

[76] Inventors: James P. Green; Paul L. Cobaris, both of 4749 Marbello Blvd., Orlando, Fla. 32805

[21] Appl. No.: 260,295

[22] Filed: May 4, 1981

[51] Int. Cl.[3] ..... A63C 17/22

[52] U.S. Cl. ..... 301/5.7; 301/37 R; 301/37 SC; 301/37 TP; 301/108 R

[58] Field of Search ..... 301/5.3, 5.7, 37 R, 301/37 SC, 37 S, 37 P, 37 CM, 37 N, 37 TP, 37 PB, 37 H, 108 R, 108 S, 108 SC, 108 A; 40/587, 591

[56] References Cited

U.S. PATENT DOCUMENTS

| | | | |
|---|---|---|---|
| 564,323 | 7/1896 | Wynkoop | 301/108 A |
| 1,790,423 | 1/1931 | Hooks | 301/5.7 X |
| 3,495,347 | 2/1970 | Sims | 301/37 N X |
| 3,883,180 | 5/1975 | Kain | 301/5.3 |
| 3,924,898 | 12/1975 | Kain | 301/108 SC |

*Primary Examiner*—Charles A. Marmor

*Attorney, Agent, or Firm*—Duckworth, Allen, Dyer & Pettis

[57] ABSTRACT

A hub assembly for roller skates having a flanged hub with a cylindrical body portion, a flat ring, and a hub plug. The body portion of the hub has a concentric molded opening therein with the ring end thereof adapted to be forced onto the axle nut of a roller skate wheel. The flat ring is disposed over the hub body against the inner surface of the flange so as to permit a plurality of projections on the inside face of the ring to form a frictional connection to the side wall of the wheel, such that rotation of the wheel causes the ring to rotate with the hub acting as a bearing. The hub plug is inserted in the outer end of the hub opening thereby giving a finished appearance. The assembly is preferably of a nylon plastic impregnated with phosphorescent or fluorescent dyes such that the assembly will glow in bright colors under ultraviolet light. The hub and flat ring protect the skate wheel bearings from dust and dirt, and the glowing, rotating rings provide an entertaining display when the skates are in use.

14 Claims, 5 Drawing Figures

HUB ASSEMBLY FOR ROLLER SKATES

BACKGROUND OF THE INVENTION

1. Field of the Invention

The present invention relates to roller skates and more particularly to revolving skatewheel ornaments attachable to the wheels of existing skates.

2. Description of the Prior Art

The sport of roller skating has seen a remarkable resurgence in the past few years. Roller skating rinks have proliferated around the country and generally feature music such as disco-type as well as older style dance music. Modern roller skates have been developed which are very comfortable with smooth quiet plastic wheels. Thus, the modern skating rinks and improved roller skates have encouragd many people to adopt the sport. Roller skating has become particularly attractive to young people who enjoy the dancing on roller skates as well as light shows and effects often used at the rinks. In addition to the use of colored lights to enhance the atmosphere of a roller skating rink, it is common to use ultraviolet or so called "black light" on occasions. Many of the participants will dress in attractive clothing and may wear articles which will fluoresce under the ultraviolet light.

Roller skates commonly used in skating rinks may utilize precision bearings in the wheels for smooth operation and are available attached to shoes with the result that such skates may be relatively expensive. Due to the normal dust and dirt that accumulates in a skating rink, the wheel bearings are subject to rapid wear and must be occasionally replaced. For this reason, a dust cap that can be attached to any pair of skates will be a useful device for extending the length of time between cleanings of bearings and can extend the life of the bearings.

SUMMARY OF THE INVENTION

The present invention is a novel hub cap device for use with existing roller skates and which may be installed on most available skates. The device includes a stationary hub element which is attachable to the axle and nut used to hold a wheel and bearing in place. A flat ring is provided having a center hole which is installed over the hub and concentric with the wheel. The ring is adapted to rotate on the hub. The inner surface of the flat ring includes a plurality of small projections which, when the device is in place, will contact the outside rim or side wall of the skate wheel and will therefore rotate along with the wheel with respect to the stationary hub. A cup-like insert is provided which may be inserted into an opening in the center of the hub and which thereby serves to completely enclose the hub for an attractive appearance.

While, in accordance with the invention, the hub assembly including the cap and the ring may be made from a variety of materials, the preferred material is a nylon plastic impregnated with fluorescent dyes. Alternatively, the material may be made phosphorescent. Thus, when a set of these devices is installed on a pair of skates and in use, the ring will spin with the wheels and will glow brightly under the influence of ultraviolet light. By utilizing a selection of different colors for hubs, rings and from wheel to wheel, a very dramatic and exciting display will result. The flat rings and the hub elements also cooperate to prevent dust and dirt from infiltrating into the wheel bearings therefore protecting the bearings from wear. As may now be seen, the invention has both aesthetic and utilitarian appeal to the skater.

It is therefore a principal object of the invention to provide a hub assembly that can be installed on existing roller skates.

It is another object of the invention to provide a hub assembly that is adapted to be installed on existing roller skates to protect the wheel berings from dust and dirt.

It is still another object of the invention to provide a hub assembly installable on an existing roller skate wheel in which a colored flat ring is provided that will rotate with the wheel.

It is yet another object of the invention to provide a hub assembly for roller skates having a rotatable flat ring in which the assembly is fabricated from a fluorescent plastic material which will glow brilliantly under ultraviolet light.

It is a further object of the invention to provide a set of hub assemblies for roller skates used in a skating rink having ultraviolet light illumination in use at times, and which will provide a dazzling and attractive appearance while the skater is skating.

These and other objects and advantages of the invention will become apparent from the following detailed description and with reference to the attached drawing.

DETAILED DESCRIPTION OF THE PREFERRED EMBDOIMENT

Figure 1:
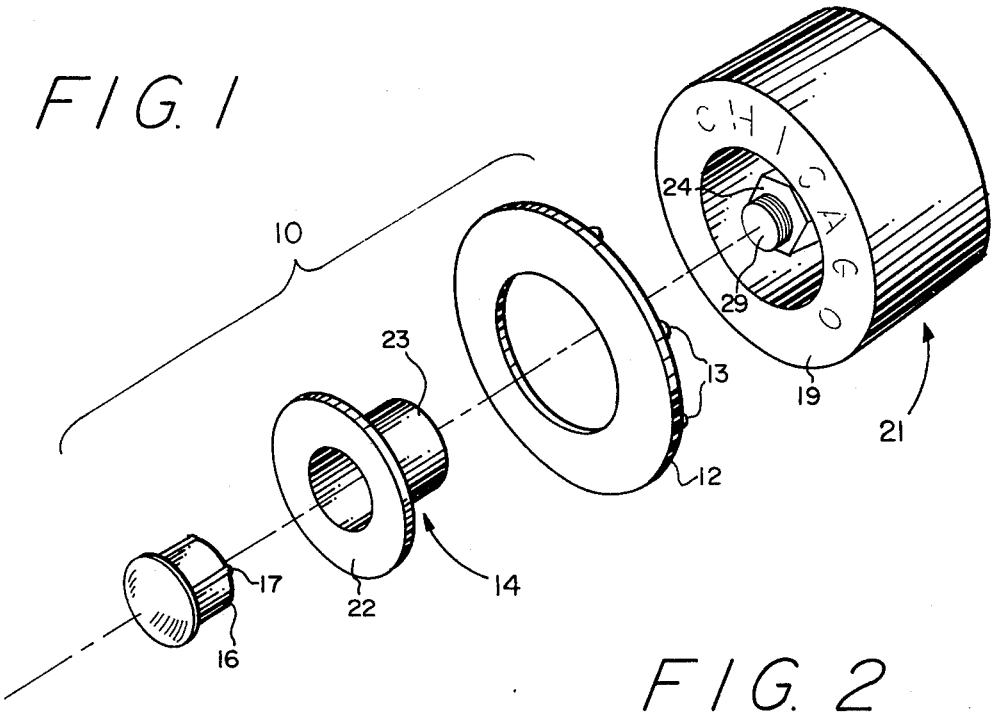
FIG. 1 is an exploded view of the hub assembly of the invention adjacent a typical skate wheel.
Figure 2:
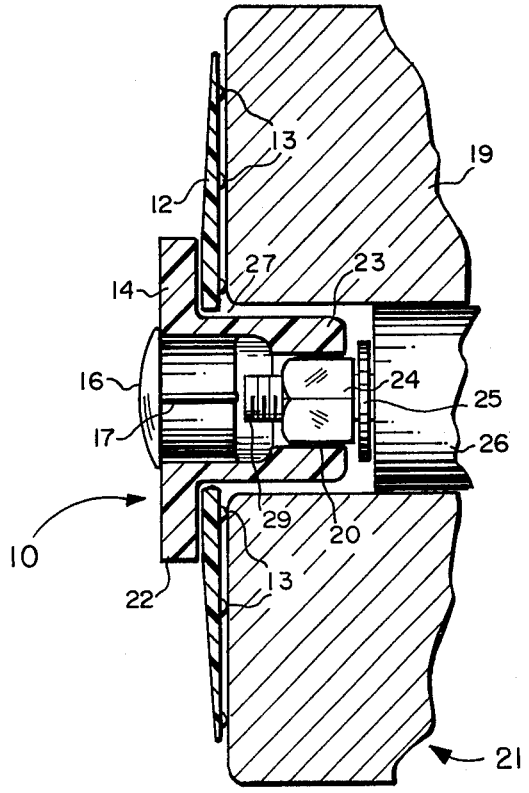
FIG. 2 is a cross-sectional view of the assembly of FIG. 1 in operating position on the skate wheel.
Figure 3:
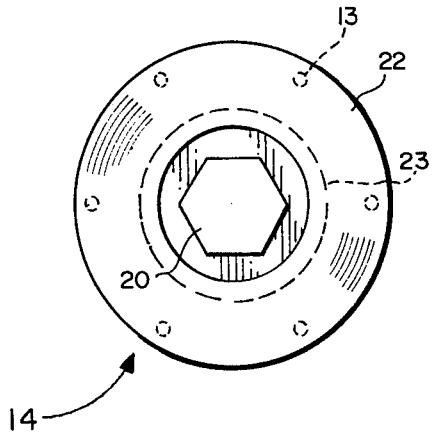
FIG. 3 is a view of the hub element of the assembly showing the opening molded therein for fitting onto the axle nut of the skate wheel.

Referring to FIGS. 1, 2 and 3 of the drawing, details of the preferred embodiment of the invention may be seen. FIG. 1 shows an exploded view of the hub device 10 of the invention consisting of three basic elements: hub 14, rotating ring 12 and cap 16 shown in exploded view adjacent to a skate wheel assembly 21 having wheel 19, axle 29 and nut 24. As best seen in FIGS. 2 and 3, hub 14 includes a body portion 23 and a flange portion 22. Body portion 23 includes a hexagonal opening 20 molded therein with opening 20 sized to fit tightly onto a skate wheel axle nut 24 which is seen in FIGS. 1 and 2 attached to axle 29. In FIG. 2, nut 24 may be noted as a portion of the existing skate wheel assembly 21 utilized to maintain bearing 26 in place with washer 25. preferably, hub 14 is molded from a self lubricating type nylon plastic material which is tough but with some pliability. Thus, proper sizing of opening 20 will allow hub 14 to be forced tightly onto nut 24 without the use of a cement of the like. Revolving flat ring 12 rides on the body portion 23 of hub 14 with area 27 acting as a bearing area. Hub 14 is inserted onto nut 24 such that projections 13 on the rear surface of flat ring 12 contact the outer side walls of skate wheel 19 without binding such that flat ring 12 may rotate as skate wheel 19 rotates due to the friction between projections 13 and the side walls of wheel 19. As may be noted from FIG. 2, the combination of hub 14 and flat ring 12 serves to seal off the normal opening in wheel assembly 21 to prevent dirt and dust from intruding into bearing 26. Cap 16 is shown inserted into the central opening of hub 14 and serves to hide the end of axle 29 giving the assembly a pleasing finished appearance.

In accordance with the invention, hub 14 and flat ring 12 both are preferably formed from nylon plastic and are impregnated with fluorescent dyes such that these parts will glow brilliantly under radiation from ultraviolet light. The separate parts may, for example, have the same color or may have contrasting colors as desired by the user. Similarly, colors may be matched from wheel to wheel on a pair of skates or, again, contrasting colors may be used. Thus, a "mix or match" combination may be selected to suit the individual taste and style of the user. In an alternative embodiment, the parts may be coated or impregnated with phosphorescent material which will glow in the dark without external excitation and will glow more brilliantly under the influence of ultraviolet light.

As may be understood, hub assembly 10 described above must have hub 14 designed to fit skate sheels having nut 24 disposed within a narrow range of distances from the side walls of wheel 21, since the flange 22 of hub 14 must be close enough to flat ring 12 to cause protrusions 13 to contact the wheel side wall. While the depth of opening 20 permits some adjustment in position of flange 22, some skate wheels may have nut 24 much further inset into wheel 21 then the example shown in FIG. 2. In such case, hub 14 would not fit. An alternative adjustable hub design, shown in FIG. 4, may therefore be adjusted to fit almost any wheel configuration. Here, hub 30 comprises two sections, outer hub 31 and inner hub 32. These sections are concentric and are interlocked by ridges 34 in the bore of outer hub 31 and circular grooves 35 in the outer surface of section 32. As may be noted, sections 31 and 32 are snapped together so as to engage the ridges 34 and grooves 35 to suit the depth of nut 24 on a particular wheel. Thus, hub 30 provides three discrete adjustments by means of grooves 35 and ridges 34 and in-between adjustments by controlling the distance that opening 33 is pushed onto the hub nut such as 24. This alternative embodiment of the hub element may be considered to be a universal ype in that the hub 30 may be set for a particular size wheel and later removed and reset for another size wheel.

Figure 5:
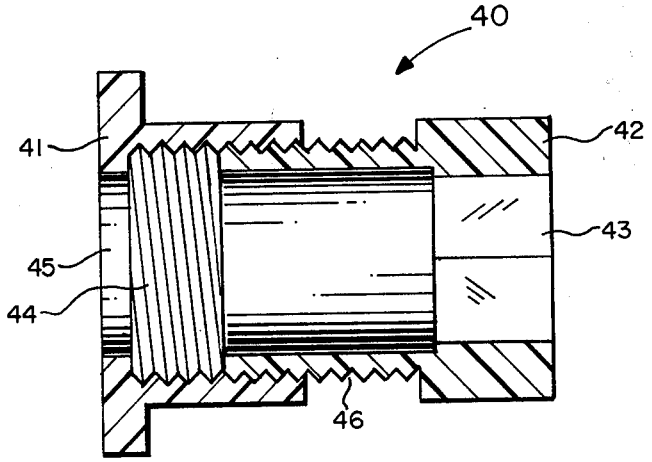
FIG. 5 is a cross-sectional view of another alternative design for the hub element that may be adjusted for a particular skate wheel.

Another alternative hub element is shown in FIG. 5 which is continuously adjustable and which may be permanently set for a specific skate wheel. Hub 40 consists of the outer hub section 41 having internal threads 44 molded therein. Inner hub section 42 has matching external threads 46. Opening 43 is molded to fit the axle nut of the wheel. Opening 45 in outer hub section 41 is provided to accept cup 16.

To adjust hub 40, a suitable cement is applied to threads 46 and the threads 44 of section 41 are started. With flat ring 12 in place, hub 40 is installed on the wheel. Hub section 41 is then screwed onto hub section 42 until the projections 13 contact the side walls of the skate wheel. The threads permit an exact setting in which sufficient friction is present between ring 12 and the wheel to ensure turning without excessive friction between ring 12 and outer hub 41. The cement is allowed to set and the hub assembly is then ready for use.

Figure 4:
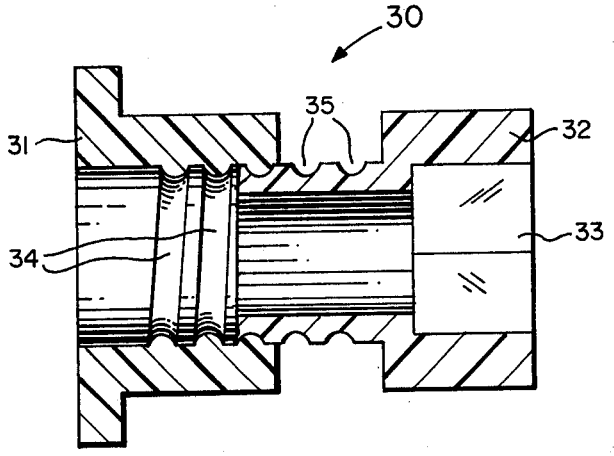
FIG. 4 is a cross-sectional view of an alternative design for the hub element which is universally adjustable.

In some instances it is desirable that the embodiment of FIG. 4 have the inner section 32 and outer section 31 such that no rotation occurs therebetween. Advantageously, by canting ridges 34 and grooves 35, as shown in FIG. 4, this characteristic is obtained without the use of cement or the like.

As may now be recognized, a novel and useful hub assembly for roller skate wheels has been described which affords protection to the wheel bearings and provides an attractive and colorful accessory to lend excitement and pleasure to the sport of roller skating, and particularly for dancing and the like in places using ultraviolet light. Although a specific design and embodiment has been disclosed, it will be obvious to those of skill in the art that many changes in materials, method of construction and attachment and the like can be made without departing from the spirit and scope of the invention. For example, the hub and flat ring may be fabricated of any material having a low coefficient of friction therebetween.

I claim:

1. A hub assembly for attachment to a roller skate wheel which has a hexagonal axle nut for retaining wheel bearings comprising:

hub means having a cylindrical body portion and an outer flange portion, the inner end of said body portion having a hexagonal opening therein in which said opening forms a force fit over the hexagonal axle nut, said hub means adapted to be installed on he hexagonal axle nut so as to provide a space between said flanged portion and the outside face of the skate wheel;

flat ring means having an outside diameter less than the diameter of the skate wheel, and an inside diameter slightly greater than the diameter of said body portion of said hub means, said flat ring means having a plurality of projections from an inner face thereof, said flat ring means installed on said body portion of said hub in said space between said flange portion and the outside face of the skate wheel with said projections in frictional contact with the outside face such that said flat ring means is free to rotate with respect to said hub means whereby said frictional contact of said projections causes said flat ring means to rotate when the skate wheel is turning in use; and whereby said hub means and said flat ring means act to protect the wheel bearings from intrusion of dirt.

2. The hub assembly as defined in claim 1 which further comprises a hub cap insertable into said hub means to produce an attractive appearance.

3. A hub assembly for use with a roller skate wheel which has an axle nut for retaining wheel bearings comprising:

hub means mountable to the bearing-retaining nut for providing a bearing surface, said hub means having an essentially hollow cylindrical body portion having an inner end with an opening therein in which said opening forms a force fit over the bearing retaining nut;

a ring like flange portion concentrically attached to the outer end of said body portion adapted to provide a space between the inner face of said flange portion and the side wall of the skate wheel, thereby providing said bearing surface thereon;

flat ring means disposed on said bearing surface of said hub means and adapted to be rotatable thereon; and friction means attached to said flat ring means for contacting the side wall of the skate wheel and adapted to cause said flat ring means to rotate on said hub bearing means in concert with rotation of the skate wheel;

whereby said hub bearing means and said flat ring means cooperate to protect the wheel bearings from contamination.

4. A hub assembly as defined in claim 3 which further comprises a hub cap insertable into the outer end of said essentially hollow body portion of said hub means.

5. The hub assembly as defined in claim 4 in which said friction means is a plurality of projections on the inner surface of said flat ring means.

6. The hub assembly as defined in claim 3 in which said hub bearing means and said flat ring means are fabricated from a plastic material in which the coefficient of friction between said flat ring means and said hub bearing means is very low.

7. The hub bearing means as defined in claim 6 in which said material is a nylon plastic.

8. The hub assembly as defined in claim 3 in which said flat ring means and said hub bearing means are fabricated from a material having the capability to fluoresce in response to ultraviolet radiation.

9. The hub assembly as defined in claim 3 in which said flat ring means and said hub bearing means are fabricated from a phosphorescent material.

10. The hub assembly as defined in claim 8 which further comprises one of said assemblies for installation on each of the four outside skate wheels of a pair of roller skates.

11. The hub means as defined in claim 3 in which said essentially hollow cylindrical body portion comprises an outer section having a concentric bore with said flange potion attached to the outer end of said outer section, and an inner section having said opening therein, said inner section adapted to partially telescope into said outer section, said outer section having a plurality of circular concentric ridges in said bore and the outer periphery of said inner section having a plurality of concentric grooves in said outer periphery, said grooves matched to said ridges, whereby said inner section may be engaged with said outer section in a plurality of discrete positions.

12. The hub means as defined in claim 11 in which said circular ridges and said circular grooves are canted to prevent rotation between said inner section and said outer section.

13. The hub means as defined in claim 3 in which said essentially hollow cylindrical body portion comprises an outer section having a concentric bore, said bore having internal threads therein with said flange portion attached to the outer end of said outer section, and an inner section having said opening therein, said inner section having external threads in its outer periphery, said external threads mating with said internal threads of said bore, whereby the overall length of said hub means is adjustable by screwing said inner section into said outer section.

14. The hub means as defined in claim 13 which further comprises cement means applied to said external threads prior to adjustment of the length thereof whereby said hub means may be permanently adjusted to a selected length.

* * * * *